US005851679A

United States Patent [19]

Stowell et al.

[11] Patent Number: 5,851,679

[45] Date of Patent: Dec. 22, 1998

[54] MULTILAYER DIELECTRIC STACK COATED PART FOR CONTACT WITH COMBUSTION GASES

[75] Inventors: William R. Stowell, Rising Sun, Ind.; John F. Ackerman, Cheyenne, Wyo.; Andrew J. Skoog, West Chester, Ohio; George E. Cook; Glenn E. Varney, both of Cincinnati, Ohio

[73] Assignee: General Electric Company, Cincinnati, Ohio

[21] Appl. No.: 768,264

[22] Filed: Dec. 17, 1996

[51] Int. Cl.[6] ..... B32B 17/06

[52] U.S. Cl. ..... 428/472; 60/752; 60/753; 359/359; 359/580; 359/585; 416/241 B; 427/419.2; 427/419.3; 428/469; 428/701

[58] Field of Search ..... 428/457, 469, 428/472, 701, 426, 432; 60/752, 753; 359/359, 580, 585; 416/241 B; 427/419.2, 419.3

[56] References Cited

U.S. PATENT DOCUMENTS

| | | | |
|---|---|---|---|
| 2,781,636 | 2/1957 | Brandes et al. . | |
| 4,030,875 | 6/1977 | Grondahl et al. . | |
| 4,055,705 | 10/1977 | Stecura et al. . | |
| 4,098,956 | 7/1978 | Blickensderfer et al. . | |
| 4,327,967 | 5/1982 | Groth . | |
| 4,399,199 | 8/1983 | McGill et al. . | |
| 4,517,217 | 5/1985 | Hoffman | 428/216 |
| 4,655,044 | 4/1987 | Dierberger et al. . | |
| 4,716,086 | 12/1987 | Gillery et al. . | |
| 4,766,563 | 8/1988 | Gillery et al. . | |
| 4,774,150 | 9/1988 | Amano et al. | 428/699 |
| 4,898,789 | 2/1990 | Finley . | |
| 4,916,022 | 4/1990 | Solfest et al. | 416/241 |
| 4,942,732 | 7/1990 | Priceman . | |
| 5,229,881 | 7/1993 | Day et al. . | |
| 5,236,752 | 8/1993 | Duderstadt et al. . | |
| 5,352,540 | 10/1994 | Schienle et al. | 428/469 |
| 5,419,971 | 5/1995 | Skelly et al. . | |
| 5,427,866 | 6/1995 | Nagaraj et al. . | |
| 5,472,795 | 12/1995 | Atita | 428/702 |

*Primary Examiner*—Archene Turner

*Attorney, Agent, or Firm*—Andrew C. Hess; Rodney M. Young

[57] ABSTRACT

A metal or ceramic matrix composite part and corresponding method are provided exhibiting desired heat transfer characteristics. The part has a metal or ceramic matrix composite substrate and a multilayer dielectric coating. The coating has high reflectivity at wave lengths corresponding to radiation wavelengths of various combustion gases and has low reflectance at radiation wavelengths corresponding to the substrate. The multilayer coating allows the heat generated external of the part at wavelengths corresponding to combustion gases to be reflected from the part while permitting radiation wavelengths associated with the substrate to pass through the coating. The parts are useful for use in combustive gas atmospheres.

16 Claims, 2 Drawing Sheets

MULTILAYER DIELECTRIC STACK COATED PART FOR CONTACT WITH COMBUSTION GASES

BACKGROUND OF THE INVENTION

1. Field of the Invention

The present invention relates to metal or ceramic matrix composite parts having low emissivity coatings and methods related thereto, and more particularly relates to such parts having low emissivity coatings suitable for high heat environments and methods related thereto.

2. Description of the Related Art

The high temperature regions of turbine engines require thermal protection for metal or ceramic matrix composite parts. Often the primary heat input to a part occurs on an outer surface so that a corresponding inner surface can be air cooled to reduce the part temperature. The amount of heat which must be removed by the cooling air can be significantly reduced by applying a high thermal impedance, such a thermal barrier coating (TBC) to the outer surface of the part. Practically, the heat removal is limited by the available cooling air, and application of TBC allows the part to run at a lower temperature. The use of cooling air and thermal barrier coatings has been established and is currently used on selected components. A second use of cooling air is to reduce the turbulent heat transfer to a part surface by forcing a cooling air flow into the stagnant air boundary layer on the surface of combustor liners and turbine blades for example.

Various coating systems have been disclosed in the past, for example: Brandes et al U.S. Pat. No. 2,781,636 issued Feb. 19,1957 discloses a low emissivity refractory material of the group consisting of fused silica, stabilized zirconia, alumina, mineral cordierite, magnesia and ceria for use as a coating material for a metal surface; Grondahl et al U.S. Pat. No. 4,030,875 Issued Jun. 21, 1977 discloses using a layer of ceramic material for lining a combustion apparatus; Stecura et al U.S. Pat. No. 4,055,705 issued Oct. 25, 1977 discloses a coating system having a bond coating containing NiCrAlY and a thermal barrier coating containing a reflective oxide such as ZrO2–Y2O3 and ZrO2–MgO; Blickensderfer et al U.S. Pat. No. 4,098,956 issued Jul. 4, 1978 discloses a thin film absorber stack consisting of an absorptive film of titanium, zirconium or hafnium suboxide, subcarbide or subnitride superposed on a reflective film of silver, aluminum or copper to provide spectrally selective solar absorbers; Groth U.S. Pat. No. 4,327,967 discloses a heat-reflecting panel having a neutral-color outer appearance having a transparent film support, such as a glass pane, an interference film having a refractive index of greater than 2 disposed on the support, a heat reflecting gold film of a thickness of 70 to 105 angstroms disposed on the side of the interference film remote from the support, and neutralization film formed from chromium, iron, nickel, titanium or alloys thereof or an alloy of chromium, aluminum and iron; Magill et al U.S. Pat. No. 4,399,199 issued Aug.16, 1983 discloses a metallic substrate having deposited thereon a first coating comprising a platinum group metal and a second coating or layer comprising a thermal barrier layer; Dierberger et al U. S. Pat. No. 4,655,044 issued Apr. 7, 1987 discloses a liner of a the combustor of a gas turbine engine being coated with a ceramic composition; Gillery et al. U.S. Pat. No. 4,716,086 issued Dec. 29, 1987 discloses a multiple layer coated article having a protective overcoat of titanium oxide; Gillery et al U.S. Pat. No. 4,786,563 issued Nov. 22, 1988 discloses a coated article having a protective overcoat of titanium oxide; Finley U.S. Pat. No. 4,898,789 issued Feb. 6, 1990 discloses a multiple layer coated article having at least two infrared reflective metal layers alternatively combined with at least three metal oxide antireflective layers to produce a coating with low emissivity and low visible reflectance to reduce heat load in automobiles; Priceman U.S. Pat. No. 4,942,732 issued Jul. 24, 1990 discloses a coated article having a refractory metal substrate having an oxidation resistant intermetallic layer formed in situ thereon; Day et al. U.S. Pat. No. 5,229,881 issued Jul. 20, 1993 discloses a glass window having various layers to produce low emissivity and low shading coefficient; Nagaraj et al U.S. Pat. No. 5,427,866 issued Jun. 27, 1995 discloses a coated article having a base article having a substrate made of a material selected from nickel-base alloys and cobalt-base alloys, an intermediate metallic coating structure, and a thermal barrier coating; Skelly et al U.S. Pat. No. 5,419,971 issued May 30, 1995 discloses an article having a ceramic thermal barrier coating; and Dederstadt et al U.S. Pat. No. 5,238,752 issued Aug. 24, 1993 discloses a thermal barrier coating system for high temperature superalloys. As is apparent from above, various coating have been employed in attempts to obtain thermal barriers for substrates.

Conventional thermal barrier coatings have had less than optimum thermal characteristics. Coatings such as yttria-stabilized zirconia at a thickness of 9 to 12 mils has approximately 40% transmittance to radiation from approximately 1 micron to approximately 6 microns in wavelength and at this standard thickness is generally opaque to radiation at wavelengths beyond about 6 microns, which can result in radiant energy from hot flames being admitted through the coating and reradiated energy from the cooler metal part being absorbed by the coating.

Consequently, there is a desire to provide coated parts having a surface coating exhibiting reflector characteristics for radiation produced external of the part and exhibiting transparency for radiation produced by the part.

SUMMARY OF THE INVENTION

A coated metal or ceramic matrix composite part is provided which has a coating exhibiting reflectivity for radiation spectrums corresponding to external radiant energies and exhibiting transparency for radiation spectrums corresponding to radiation produced by the substrate of the part. The coated parts are preferably metal or ceramic matrix composite parts for combustion atmospheres such as nozzles, liners, turbines and combustors. The coating has low emissivity in selected wave lengths and high transmissivity in other wavelengths. An example of characteristics of such a coating would exhibit reflectance of spectral energy produced by a flame at 3500 degrees F to 4000 degrees F while being transparent to radiation produced by the part operating at 1600 degrees F to 2000 degrees F in the remaining spectral regions. It is envisioned that such a coating can reduce the part temperature by 180 degrees F for an external temperature of 3500 degrees F and a part temperature of 1600 degrees F for a given flow of air. For conventional combustion gas atmospheres the high reflectance of the coating is in the spectral region of radiation peaks associated with carbon dioxide and water and the high transmittance is in the spectral region of radiation peak for the hardware. The coating has multiple layers of various materials and various thicknesses and is specifically tailored to provide in combination a reflectance associated with gas radiation peaks and to be generally transparent over other radiation spectral regions.

DETAILED DESCRIPTION OF THE DRAWINGS

Figure 1:
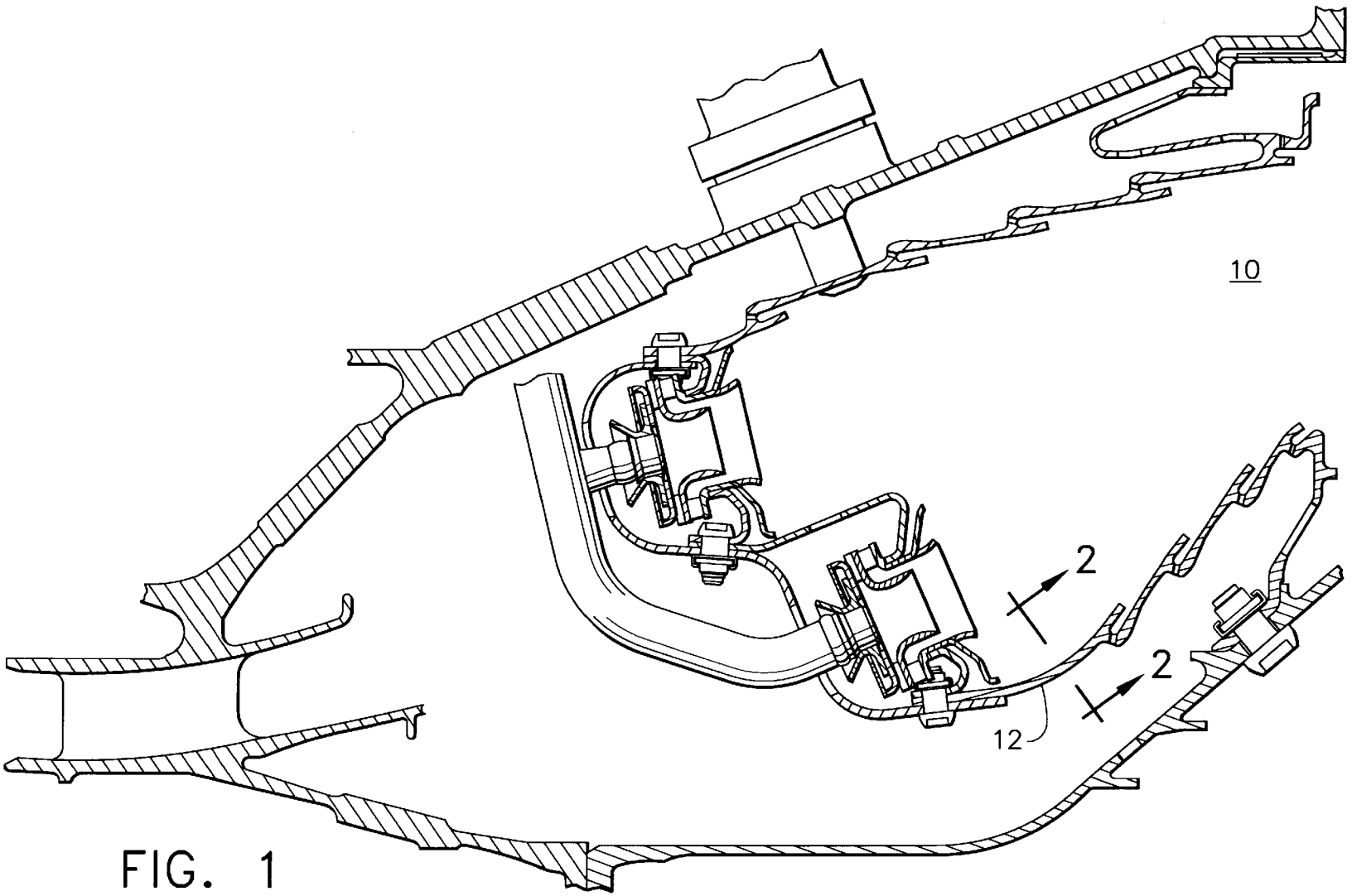
FIG. 1 is a perspective view of a combustor having a liner coated according to the present invention.
Figure 2:
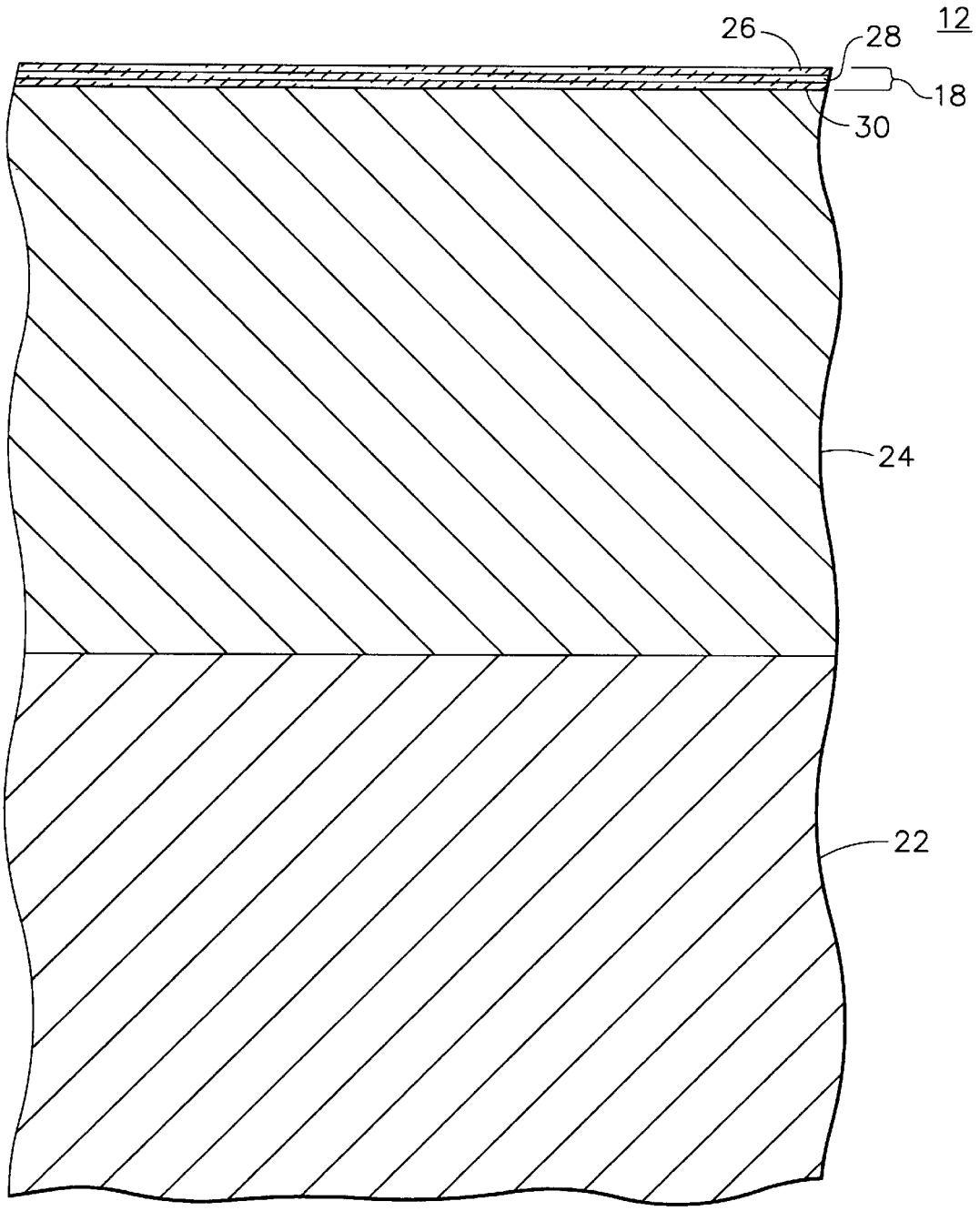
FIG. 2 is a cross-sectional view of the combustor liner of FIG. 1 taken along line 2—2 having a coating according to the present invention.

As shown in FIGS. 1 and 2, a coated article or part (10), such as a combustor (10), has a liner (12) having a metal or ceramic matrix composite substrate (22) and a multilayer dielectric coating (18) comprising multiple layers (26, 28, 30) wherein the multilayer coating provides a low emissivity for a radiation peak corresponding to a particular hot gas typically found in combustion atmospheres, and optionally has a thermal barrier coating (24) between the coating (18) to the substrate (22). For example, two common gases in combustion atmospheres are $H_2O$ (water) and $CO_2$ (carbon dioxide) which each have multiple radiation spectral peaks. Water has radiation spectral peaks at 1.1 microns, 1.3 microns, 1.9 microns, 2.7 microns and 6.5 microns wavelength, and carbon dioxide has radiation spectral peaks at 2.8 microns and 4.2 microns wavelength. Selection of the coatings in suitable thickness allows for reflective characteristics which correspond to the desired radiation spectral peaks. A suitable part (10) would have multiple layers of alternating materials and thicknesses, and for example would provide for reflectance of radiant energy in the 1.1 to 3 micron wavelength range, and a reflectance of radiant energy in the 4.0 to 10.0 micron wavelength range. Optionally, the coating layers may for example provide for a reflectance of energy at wavelength in the range 1.1 and 3 microns and a reflectance of radiant energy having a wavelength in the 4.0 to 10.0 micron wavelength range, and the coating has a high transmissivity over the remaining ranges to permit radiant heat from the substrate to be emitted from the part while the coating reflects the radiation corresponding to the surrounding hot gases. Preferably the coating exhibits an average reflectance of at least 80 percent for the wavelength range of 1 micron to 2.9 microns, of at least 80 percent for the wavelength range of 4.0 to 4.5 microns, and less than 30 percent for the wavelength range of 2.9 to 3.9 microns. The part (10) may be any part contacted with hot gases such as a nozzle, a combustor liner, turbine blades, turbine vanes, a centerbody, an augmentor or a combustor or any parts associated therewith. In other words, a suitable coating would be designed to reject the radiant heat load where it occurs spectrally. A suitable multilayer coating would reject heat in the band from 1 to 2.9 microns and from 4.0 to 4.4 microns, and this design would apply to combustors in which the flame temperature runs at 3500 degrees Fahrenheit (F).

In other words, the coating may have multiple layers of various materials and thicknesses thereby having low emissivity corresponding to particular radiation peaks of particular combustion gases specifically reflecting the radiation generated by the gases while permitting maximum transparency for the radiation wavelengths emitted by the substrate. An example of materials suitable as high index layers include $TiO_2$, $ZrO_2$, $Ta_2O_5$, $HfO_2$, NbO, and $Y_2O_5$, and examples of materials suitable as low index layers include $SiO_2$, $Al_2O_3$, $MgF_2$, and $BaF_2$. The high index layers and low index layers preferably alternate and have desired thickness levels to provide the desired level of reflectance at the desired wavelength. It is believed that the present invention can reduce temperatures of the underlying structures by 12 degrees F to 180 degrees F depending upon the structure. For example, it is believed that combustor splash plate temperatures could be reduced by 50 to 90 degrees F resulting in optionally reducing the required cooling flow by more than 40 percent. Heat shields, domes, liners and seals could each also experience substantial reductions in temperature with the present coatings. It is believed that for combustors a coating of the present invention could weigh less than 1 pound per 100 square feet, have a thickness of less than 0.4 mils, exhibit abrasion resistance and high chemical resistance, be suitable for use in excess of 2100 degrees F.

A thermal barrier coating of stabilized zirconia may be located between the substrate and the multilayer stack. The thermal barrier coating (adhered to the substrate) reduces the turbulent heat load while the multilayer stack (reflector) (adhered to the thermal barrier coating) reduces the radiant heat load.

Although the invention has been described relative to preferred embodiments thereof, it will be understood by those skilled in the art that variations and modifications can be effected in this preferred embodiment without departing from the scope and spirit of the invention.

We claim:

1. A coated part for use in combustive gas atmospheres, said part comprising:

(a) a substrate, and (b) a multilayer dielectric coating disposed on said substrate, said coating exhibiting an average reflectance of at least 80 percent for the wavelength range of 1 micron to 2.9 microns, of at least 80 percent for the wavelength range of 4.0 to 4.5 microns, and less than 30 percent for the wavelength range of 2.9 to 3.9 microns.

2. The part of claim 1 wherein said coating exhibits an average reflectance of less than 20 percent for the wavelength range of 2.9 to 3.9 microns.

3. The part of claim 1 wherein said coating exhibits an average reflectance of at least 90 percent for the wavelength range of 1.0 micron to 2.5 microns.

4. The part of claim 1 wherein said coating comprises a metal oxide.

5. The part of claim 1 wherein said part is selected from gas turbine nozzles, combustor liners, turbine blades, turbine vanes, centerbodies, augmentors and combustors.

6. The part of claim 1 wherein said substrate is a metal substrate.

7. The part of claim 6 wherein said substrate is selected from the group consisting of nickel-base alloys and cobalt-base alloys.

8. The part of claim 1 wherein said substrate is a ceramic matrix composite substrate.

9. The part of claim 1 wherein said coating has a transmissivity of at least 0.8 at the peak radiation wave length generated by the substrate.

10. The part of claim 9 wherein said peak radiation wave length generated by said substrate is between 3 and 4 microns.

11. The part of claim 1 wherein said part has a stabilized zirconia thermal barrier coating between said substrate and said multilayer dielectric coating.

12. A method for producing a coated part, said process comprising:

(a) providing a substrate, (b) applying to said substrate a plurality of layers of alternating materials having various thicknesses to provide a coating exhibiting an average reflectance of at least 80 percent for the wavelength range of 1 micron to 2.5 microns, of at least 80 percent for the wavelength range of 4.0 to 4.5 microns, and less than 30 percent for the wavelength range of 2.6 to 3.9 microns.

13. The method of claim 12 wherein said substrate is a nickel/cobalt superalloy.

14. The method of claim 12 wherein said substrate is a ceramic matrix composite.

15. The method of part of claim 12 wherein said multilayer coating has a transmissivity of at least 0.8 at the peak radiation wave length generated by the substrate.

16. The method of claim 15 wherein said peak radiation wave length generated by said substrate is between 3 and 4 microns.

* * * * *